United States Patent [19]

Gibas et al.

[11] 4,403,753

[45] Sep. 13, 1983

[54] COIL SPOOL FOR AN ELECTROMAGNETIC DEVICE

[76] Inventors: Christoph Gibas, Neunkirchener Weg 5, 5908 Neunkirchen; Michael Müller, Zum Turm 1, 6683 Spiesen/Elversberg, both of Fed. Rep. of Germany

[21] Appl. No.: 281,563

[22] Filed: Jul. 8, 1981

[30] Foreign Application Priority Data

Jul. 15, 1980 [DE] Fed. Rep. of Germany ..... 3026760

[51] Int. Cl.[3] ..... B65H 75/28; H01F 15/10

[52] U.S. Cl. ..... 242/125.2; 336/192

[58] Field of Search ..... 242/118, 118.4, 118.5, 242/125–125.3; 336/185, 189–192, 196, 197, 209

[56] References Cited

U.S. PATENT DOCUMENTS 3,117,294 1/1964 Muszynski et al. ..... 336/192

3,131,371 4/1964 Brekke et al. ..... 336/192

*Primary Examiner*—Leonard D. Christian

*Attorney, Agent, or Firm*—Roylance, Abrams, Berdo & Farley

[57] ABSTRACT

A coil spool or bottom for an electromagnetic device has a central part about which a coil is wound and end flanges, one of which is formed with pockets for receiving the ends of the coil wire at the points of connection to external conductors. The junctions are received within the pockets and need no separate insulation. Notches and slots at the sides of the pockets are provided for entry and exit of the wires.

6 Claims, 7 Drawing Figures

COIL SPOOL FOR AN ELECTROMAGNETIC DEVICE

This invention relates to a coil spool or bobbin having improved means for receiving and holding the ends of a coil wound thereon and, in particular, for receiving connections between those wires and external conductors.

BACKGROUND OF THE INVENTION

A known coil bobbin for use in an apparatus of this general type includes a coil bobbin for an electromagnetic device in which the bobbin has end flanges, one of the flanges being provided with a hole therethrough so that both of the end wires can be passes through the hole. A projection is provided on the outer surface of that flange, projecting away from the opposite flange. With this arrangement, the coil wires are not separated from each other, and connections thereto are made outside of the bobbin structure itself.

BRIEF DESCRIPTION OF THE INVENTION

An object of the present invention is to provide a coil bobbin in which the connection points between the ends of the coil wires and insulated external conductors are protected from contact with each other without necessitating separate insulation of the specific junction points.

Briefly described, the invention includes an improved coil spool for an electromagnetic device of the type having a coil spool with a central cylindrical portion and radially extending end flanges, and a wire coil wound on the cylindrical portion wherein the improvement comprises means defining first and second outwardly opening pockets formed on one of the flanges for receiving connections between the ends of the wire coil and external conductors.

As will be recognized, the pockets provide locations where connections of the coil wire ends to the external conductors can be placed separated from each other, the external wires being insulated, but without additional insulation for the specific junctions. The insulated external connection wires are then led outwardly from the pockets.

In order that the manner in which the foregoing and other objects are attained in accordance with the invention can be understood in detail, particularly advantageous embodiments thereof will be described with reference to the accompanying drawings, which form a part of this specification, and wherein.

Figure 1:
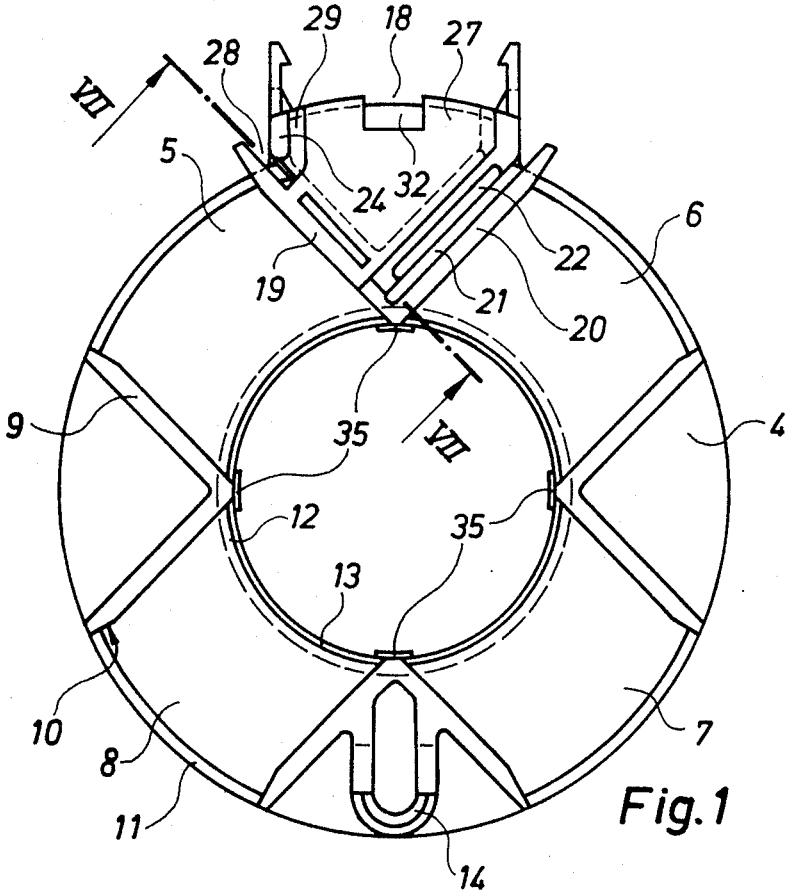
FIG. 1 is a bottom plan view of a coil spool or bobbin in accordance with the present invention, viewed in the direction of arrow A of FIG. 2.
Figure 2:
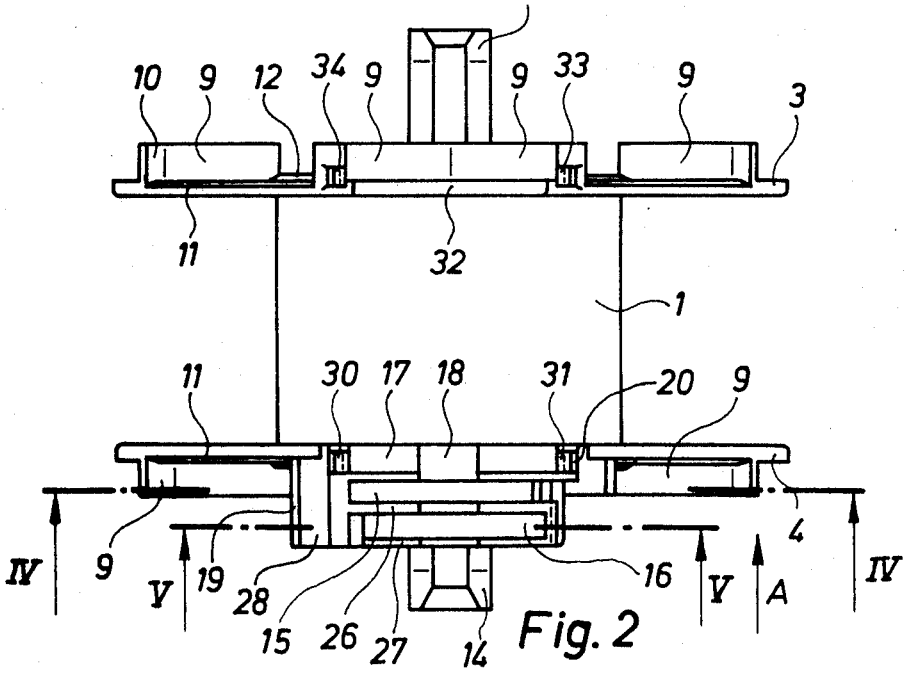
FIG. 2 is a front elevation of the structure of FIG. 1.

The specific embodiment of the invention chosen for illustration herein is a coil bobbin manufactured from a moldable plastic material and is especially designed for use, with a coil, as an alternating current magnet particularly for the operation of a hydraulic valve system, but it will be recognized that the improved bobbin structure has wide application.

As shown in the figures, the coil spool or bobbin includes a hollow, central cylindrical part 1 and two radially extending generally circular flanges 3 and 4 which extend outwardly from the ends of the cylindrical part. In its final assembly, the hollow cylindrical part would contain an armature guide pipe and a pole core, not shown, and the space surrounding central portion 1 between flanges 3 and 4 receives a coil of wire which is wound around the central part.

Flange 4 is provided with means defining four guide slots 5, 6, 7 and 8 on its outer surface, i.e., that surface facing away from flange 3, the guide slots being arranged in orthogonal or cruciform arrangement. Flange 3 has essentially the same configuration of slots, not separately identified by reference numerals. The slots on the two flanges are axially aligned so that they are capable of receiving the legs of bundles of generally U-shaped laminations. These laminations would, in the final structure, cooperate with the coil to form the magnetic apparatus. Guide slots 5–8 are defined by axially protruding ribs 9. Each two adjacent ribs 9 ae disposed at right angles to each other. Each of the ribs has a bevelled surface 10 adjacent its radially outer limit which causes a widening of its associated slot 5–8. The edges of flanges 3 and 4 are bevelled in the vicinity of the slots as indicated at 11, the bevelled surfaces 10 and 11 serving to simplify the installation of bundles of laminations. Each of flanges 3 and 4 is provided with a thickened or heightened region at the inner region thereof, axially adjacent the central cylindrical portion, with an annular bevelled surface 12, forming bevels at the inner limits of slots 5–8 to support the inner ends of legs of the bundles of laminations and retain them in proper position. The edge part adjacent to the bevelled surface 12 is formed with a step or shoulder 13 for simplified insulation of the armature guide pipe.

Figure 3:
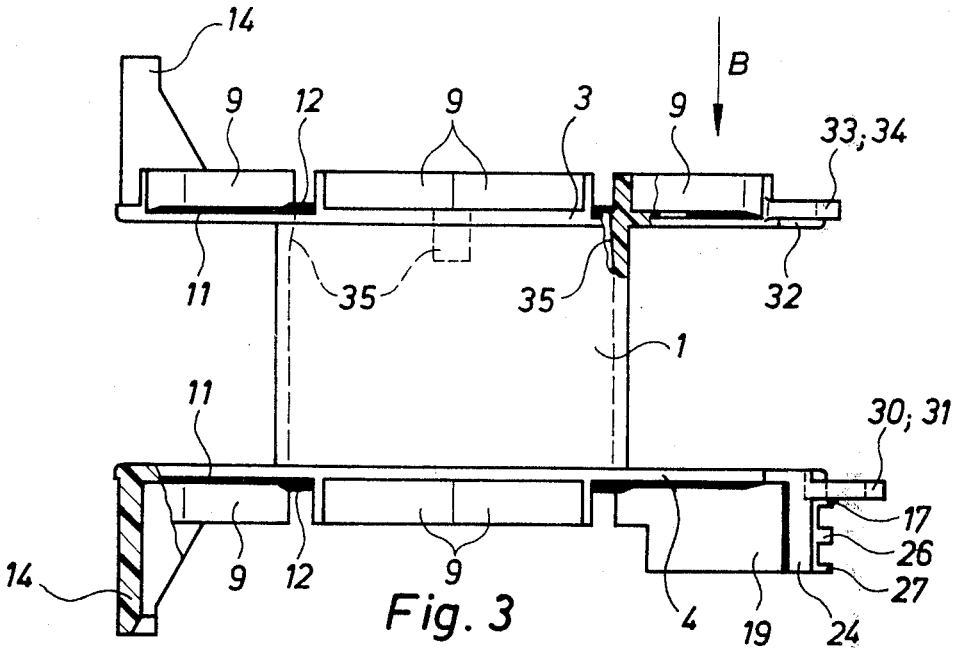
FIG. 3 is a side elevation, in partial section, of the structure of FIGS. 1 and 2.

Between guide slots 7 and 8, in the area of the edges of flange 4, is a hollow adjustment pin 14 which is U-shaped as seen from below (FIG. 1) and has a semi-circular middle area. The foot of adjustment pin 14 is relatively long and is connected with the adjacent rib 9 of guide slots 7 and 8. Seen from the side, the pin is wedge-shaped in the middle. Only the end of adjustment pin 14 is semi-circular, and the inside edge is bevelled (FIG. 3).

Flanges 3 and 4 are constructed in a substantially identical form as to the aforementioned features and differ only in the following features.

Figure 4:
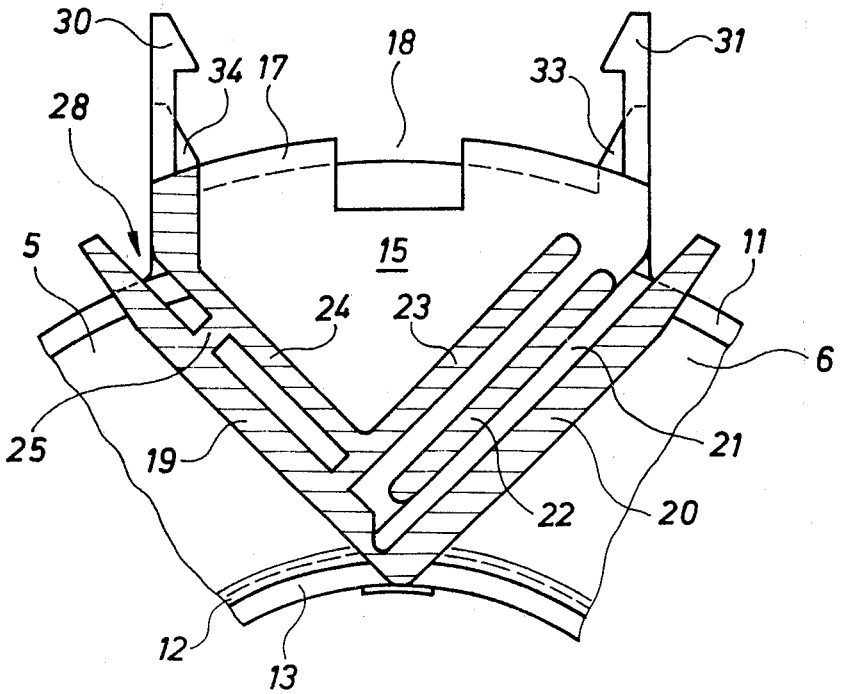
FIGS. 4 and 5 are partial sectional views along lines IV—IV and V—V respectively, of FIG. 2.
Figure 5:
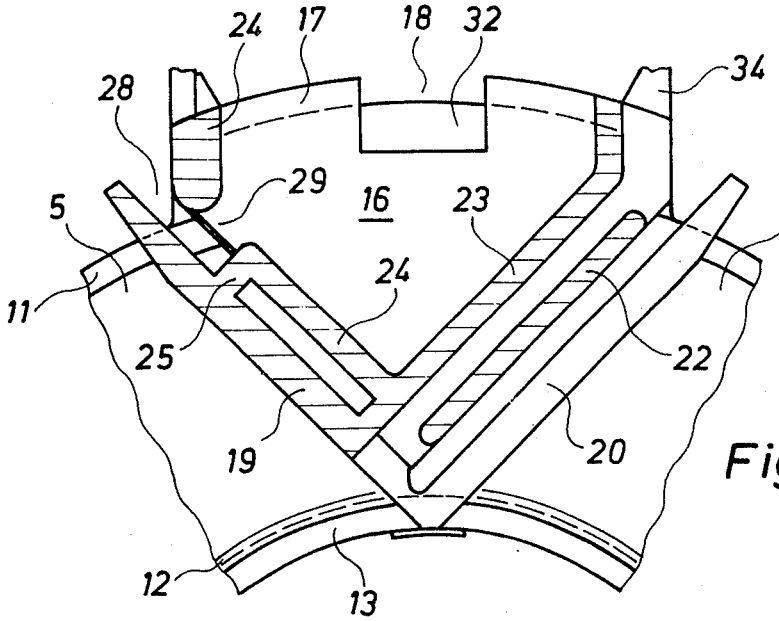
Figure 6:
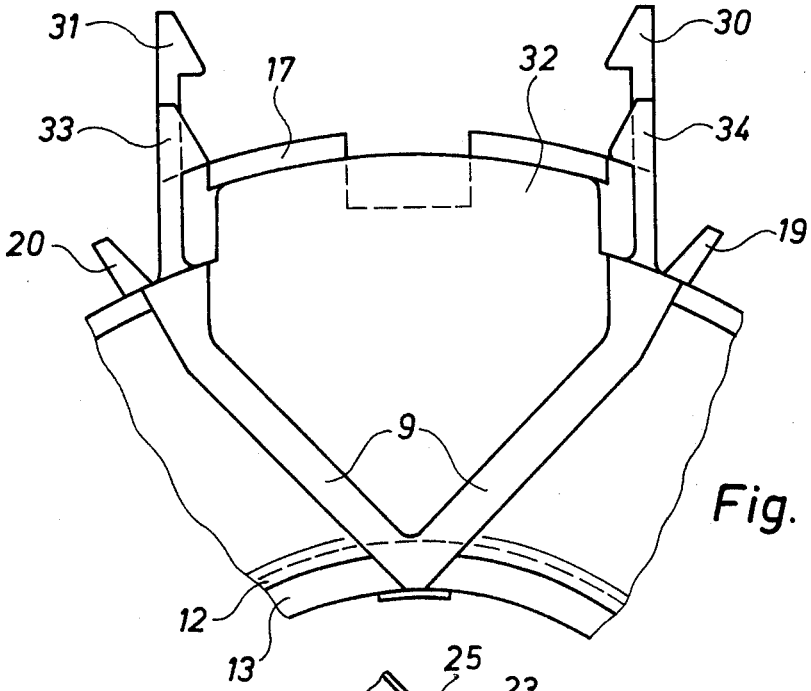
FIG. 6 is a partial top plan view, enlarged, in the direction of arrow B of FIG. 3.
Figure 7:
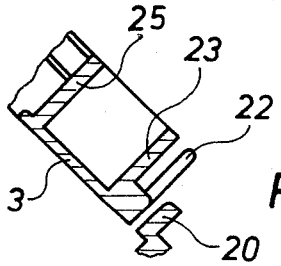
FIG. 7 is a partial sectional view along line VII—VII of FIG. 1.

On flange 4 is provided means defining two pockets 15 and 16 on the side of the flange radially opposite the adjustment pin and on the outer surface which faces away from flange 3. FIG. 4 shows a transverse sectional view through pocket 15 and FIG. 5 shows a transverse sectional view through pocket 16. Pockets 15 and 16 are axially aligned with each other. Flange 4 has a radial projection 17 the width of which corresponds approximately to the periphery of the flange 4 between two ribs 9, parts 19 and 20 thereof forming an angle. Projection 17 is somewhat thicker than flange 4 and has a cutout or notch 18 in the middle thereof for the insertion of an external connection wire, not shown. Directly adjacent rib 20 is a notch 21 which extends through the flange from the outside to the hollow cylindrical part 1 at the side of rib away from guide slot 6 through which the inside end of the wire forming the coil can be passed. Thus, the wire can be inserted radially from the outer end of the notch to the inner end. Adjacent to notch 21 is a wall 22 which extends parallel to rib 20 and which reaches nearly to the outside edge of flange 4 and the end of which terminates at a small distance from rib 19, this distance being slightly greater than the diameter of a coil wire. Ribs 19 and 20 extend radially outwardly to the outside edge of flange 4. A wall 23, which forms the main side component defining pockets 15 and 16 and which extends from rib 19 almost to the edge of flange 4, is at some distance from and is parallel to wall part 22.

A wall part 24 extends parallel with rib 19 and forms a wall of both of pockets 15 and 16. Rib 19 is connected with wall part 24 by a short cross piece 25. Wall part 24 extends from wall 23 nearly to the edge of flange 24 parallel with rib 19 and finally curves outwardly at an angle of approximately 45° in the area of projection 17 and terminates there.

Pockets 15, 16 are separated from each other by walls 26 and 27 which lie in planes parallel to the plane containing flange 4 and mutually spaced from each other. Both wall parts 23 and 24 are connected with wall parts 26 and 27, whereas wall 22 is free standing. Walls 26 and 27 have cutouts axially aligned with the cutout or notch 18 of projection 17.

The inside end of the wire forming the wire coil can be inserted radially from the outside into notch 21 and then continues from the space between flanges 3 and 4 over the inner end of notch 21 into the space between walls 22 and 23. It can then be bent around the free end of wall part 23 and lies with its distal end, to which connection is to be made with the external connection wire, in pocket 15 from which the connection wire passes out of the pocket and can be inserted into either cutout 18 or into the corresponding axially aligned cutouts of wall parts 26 and 27, depending upon which direction the connection wire is to extend from pockets 15 or 16.

Between rib 19 and wall 24 is a slot parallel to the axis which is connected with the space defined by cross piece 25 between rib 19 and wall 24. This space is open axially and is in communication with a cutout 29 in wall part 27 at an angle to the outside radius on the side of wall 24 turned away from slot 28 (FIG. 1), which leads into pocket 16. Wall 24 is interrupted by notch 29 in the area of pocket 16.

The outside end of the wire coil is inserted into slot 28, fed into notch 29 between rib 19 and wall 24, and passes into pocket 16 in which it can be connected to the external connection wire which can then be arranged in the same manner as the wire connected to the inside end of the wire coil. The junction points of both ends of the wire coil are separated from each other by the walls defining pockets 15 and 16 so that the junction points need not be separately insulated from each other.

On both sides of projections 17 are provided detents 30 and 31, which extend outwardly at an angle to the radius but parallel to each other, and which are turned toward each other. A projection 32, corresponding to projection 17, is found on flange 3 which, however, does not project radially outwardly as far as projections 17. On both sides of projection 23 are provided similar detents 33 and 34 at the same distance from the edge of flange 3, which are structured the same as detents 30 and 31, but do not project radially outwardly as far. Detents 30–34 are provided for the purpose of engaging a support plate having plugs for connection to the external wires, not shown.

Wedge-shaped projections 35 are formed on the inside wall of hollow cylindrical part 1, projecting inwardly, in the area of flange 3 and at the corners of two ribs 9 which are fitted together (FIG. 3) for the purpose of guiding the armature pole tube (not shown) which is inserted from the side of flange 4 into the hollow cylindrical part 1 of the coil bobbin.

The coil bobbin can be used to form a direct current magnet. It can also be used for switching magnet which can be either of the direct current or alternating current type.

As will be recognized, a different number of bundles of laminations other than four can alternatively be used, in which case the guide slots would be arranged so that the bundles lie in an arrangement other than cruciform.

While certain advantageous embodiments have been chosen to illustrate the invention, it will be understood by those skilled in the art that various changes and modifications can be made therein without departing from the scope of the invention as defined in the appended claims.

What is claimed is:

1. A coil spool for an electromagnetic device, comprising a central cylindrical portion for receiving a wire coil thereon;

first and second end flanges extending radially from and axially spaced along said central cylindrical portion;

first and second outwardly opening pockets for receiving connections between wire coil ends and external conductors, said pockets being axially aligned relative to said central cylindrical portion and formed on said first end flange, and including a first notch extending on said first end flange at an acute angle with a radius and at one side of said pockets through which a wire from one wire coil end can pass to said first pocket, wall means adjacent said first notch defining a slot for receiving said wire, and a second notch extending through said first end flange at the other side of said pockets through which a wire from the other wire coil end can pass to said second pocket, whereby said wires can be led into said pockets within the flange circumference.

2. A coil spool according to claim 1 wherein said pockets protrude beyond the periphery of said first end flange and include a third notch centrally disposed for receiving an external conductor.

3. A coil spool for an electromagnetic device having a wire coil with inner and outer ends, comprising a central cylindrical portion for receiving the wire coil thereon and extending along an axis;

first and second end flanges mounted on opposite axial ends of said cylindrical portion such that the wire coil can be received therebetween; and first and second radially outwardly opening pockets for receiving connections between wire coil ends and external conductors, said pockets being formed on a surface of said first end flange facing away from said second end flange, said first pocket having first means for receiving a connection between the wire coil inner end and a first external conductor, and said second pocket having second means for receiving a connection between the wire coil outer end and a second external conductor, said second means including a slot on the periphery of said first end flange extending parallel to said axis.

4. A coil spool according to claim 3 wherein said first means comprises a first notch on said first end flange extending at an acute angle with a radius and at one side of said pockets through which a wire from the wire coil inner end can pass to said first pocket.

5. A coil spool according to claim 4 wherein said first means includes a wall means adjacent said first notch defining a slot for receiving the wire coil inner end.

6. A coil spool according to claim 3 wherein said pockets are axially aligned relative to said central cylindrical portion.

* * * * *